US008913768B2

(12) United States Patent
Kates

(10) Patent No.: US 8,913,768 B2
(45) Date of Patent: Dec. 16, 2014

(54) HEARING AID WITH IMPROVED COMPRESSION

(75) Inventor: James M. Kates, Niwot, CO (US)

(73) Assignee: GN Resound A/S, Ballerup (DK)

( * ) Notice: Subject to any disclaimer, the term of this patent is extended or adjusted under 35 U.S.C. 154(b) by 73 days.

(21) Appl. No.: 13/456,703

(22) Filed: Apr. 26, 2012

(65) Prior Publication Data

US 2013/0287236 A1 Oct. 31, 2013

(30) Foreign Application Priority Data

Apr. 25, 2012 (DK) ..... 2012 70210
Apr. 25, 2012 (EP) ..... 12165500

(51) Int. Cl.
*H04R 25/00* (2006.01)

(52) U.S. Cl.
USPC ..... 381/312; 381/321

(58) Field of Classification Search
CPC .... H04R 25/00; H04R 25/556; H04R 25/652; H01R 12/59; H01R 43/00
USPC ..... 381/312, 316–318, 320–321
See application file for complete search history.

(56) References Cited

U.S. PATENT DOCUMENTS 4,718,099 A * 1/1988 Hotvet ..... 381/317
5,832,097 A * 11/1998 Armstrong et al. ..... 381/321
5,838,807 A * 11/1998 Andersson et al. ..... 381/321
6,104,822 A 8/2000 Melanson et al.
6,198,830 B1 3/2001 Holube et al.
6,868,163 B1 * 3/2005 Goldstein ..... 381/321
2007/0019833 A1 1/2007 Barthel
2011/0013794 A1 1/2011 Hau et al.
2012/0082330 A1 4/2012 Kornagel et al.

FOREIGN PATENT DOCUMENTS

EP 1 448 022 A1 8/2004
WO 99/34642 A1 7/1999
WO 2005/107319 A1 11/2005
WO 2006/102892 A1 10/2006

OTHER PUBLICATIONS

First Technical Examination dated Nov. 9, 2012, for Danish Patent Application No. PA 2012 70210.
Extended European Search Report dated Sep. 3, 2012 for EP Patent Application No. 12165500.5.

* cited by examiner

*Primary Examiner* — Suhan Ni
(74) *Attorney, Agent, or Firm* — Vista IP Law Group, LLP

(57) ABSTRACT

A hearing aid includes a microphone for conversion of acoustic sound into an input audio signal, a signal processor for processing the input audio signal for generation of an output audio signal; and a transducer for conversion of the output audio signal into a signal to be received by a human, wherein the signal processor includes a compressor with a compressor input/output rule that is variable in response to a signal level of the input audio signal.

15 Claims, 20 Drawing Sheets

| Band Number | Center Frequency, Hz |
|---|---|
| 1 | 0 |
| 2 | 149 |
| 3 | 300 |
| 4 | 457 |
| 5 | 623 |
| 6 | 803 |
| 7 | 1001 |
| 8 | 1225 |
| 9 | 1486 |
| 10 | 1798 |
| 11 | 2184 |
| 12 | 2684 |
| 13 | 3360 |
| 14 | 4327 |
| 15 | 5784 |
| 16 | 8009 |
| 17 | 11025 |

Table 1

Band center frequencies for the 17-band warped frequency analysis.

Fig. 11

| Amplified Spectrum | | Adaptive Gain Adjustment | |
|---|---|---|---|
| Minimum | Peak | g50 | g80 |
| Initial | Initial | NAL-RP | NAL-RP |
| Above threshold | Below LDL | Slow decay towards NAL-RP<br><br>If g50 < NAL<br>g50=g50 + α dB<br>else<br>g50=g50 - α dB<br>end | Slow decay towards NAL-RP<br><br>If g80 < NAL<br>g80=g80 + α dB<br>else<br>g80=g80 - α dB<br>end |
| Below threshold | Below LDL | Slow gain increase<br>g50=g50 + α dB | Slow gain increase<br>g80=g80 + α dB |
| Above threshold | Above LDL | Rapid gain decrease<br>g50=g50 - ß dB | Rapid gain decrease<br>g80=g80 - ß dB |
| Below threshold | Above LDL | Slow gain increase<br>g50=g50 + α dB | Rapid gain decrease<br>g80=g80 - ß dB |

Table 2

Summary of the quasi-linear (QL) adaptive compression gain adjustment based on the stored audiogram and LDL. g50 is the gain for an input at 50 dB SPL and g80 is the gain for an input at 80 dB SPL. The g50 and g80 values are converted into the compression input / output rule.

Fig. 12

| Amplified Spectrum Minimum | Adaptive Gain Adjustment | |
|---|---|---|
| | g50 | g100 |
| Initial | NAL-RP | NAL-RP |
| Above Threshold | Slow decay towards NAL-RP<br><br>If g50 < NAL<br>g50=g50 + α dB<br>else<br>g50=g50 - α dB<br>end | NAL-RP |
| Below Threshold | Slow gain increase<br>g50=g50 + α dB | NAL-RP |

Table 3

Summary of the minimum compression ratio (MinCR) adaptive compression gain adjustment based on the stored audiogram. g50 is the gain for an input at 50 dB SPL and g100 is the gain for an input at 100 dB SPL. The g50 and g100 values are converted into the compression input / output rule.

Fig. 13

| Factor | df | df (error) | F | p |
|---|---|---|---|---|
| Talker | 1 | 17 | 0.095 | 0.761 |
| SNR | 2 | 34 | 53.924 | <.001* |
| Level | 2 | 34 | 14.232 | <.001* |
| Processing | 5 | 85 | 1.106 | 0.344 |
| Talker × SNR | 2 | 34 | 11.963 | <.001* |
| Talker × Level | 2 | 34 | 4.542 | 0.018* |
| Talker × Processing | 5 | 85 | 1.240 | 0.298 |
| SNR × Level | 4 | 68 | 1.638 | 0.175 |
| SNR × Processing | 10 | 170 | 0.787 | 0.641 |
| Level × Processing | 10 | 170 | 1.813 | 0.120 |
| Talker × SNR × Level | 4 | 68 | 3.517 | 0.011* |
| Talker × SNR × Processing | 10 | 170 | 0.456 | 0.816 |
| Talker × Level × Processing | 10 | 170 | 1.909 | 0.108 |
| SNR × Level × Processing | 20 | 340 | 1.015 | 0.443 |
| Talker × SNR × Level × Proc | 20 | 340 | 0.939 | 0.538 |

Table 4

Results of the 4-way repeated measures ANOVA for the arcsine-transformed intelligibility scores. If Mauchly's test of sphericity was significant, Greenhouse-Geisser adjusted values are reported. Significant results are indicated by an asterisk.

Fig. 14

| SNR, dB | Level, dB SPL | | | |
|---|---|---|---|---|
| | 75 | 65 | 55 | Average |
| No Noise | 0.967 | 0.977 | 0.931 | 0.958 |
| 15 | 0.956 | 0.940 | 0.927 | 0.941 |
| 5 | 0.864 | 0.874 | 0.821 | 0.853 |
| Average | 0.929 | 0.930 | 0.893 | |

Table 5

Intelligibility proportion keywords correct averaged over listener, talker, and processing.

Fig. 15

| Test | Processing | | | | | |
|---|---|---|---|---|---|---|
| | NAL-R | NAL-NL1 | QL 15 | QL 7.5 | MinCR 15 | MinCR 7.5 |
| Intelligibility | 0.907 | 0.912 | 0.920 | 0.925 | 0.922 | 0.919 |
| Quality | 0.527 | 0.513 | 0.547 | 0.550 | 0.543 | 0.543 |

Table 6

Intelligibility proportion keywords correct and normalized quality ratings averaged over listener, talker, SNR, and level.

Fig. 16

| Factor | df | df (error) | F | p |
|---|---|---|---|---|
| Talker | 1 | 17 | 0.247 | 0.626 |
| SNR | 2 | 34 | 127.320 | <.001* |
| Level | 2 | 34 | 6.440 | 0.015* |
| Processing | 5 | 85 | 2.367 | 0.087 |
| Talker × SNR | 2 | 34 | 0.211 | 0.810 |
| Talker × Level | 2 | 34 | 0.105 | 0.833 |
| Talker × Processing | 5 | 85 | 1.180 | 0.326 |
| SNR × Level | 4 | 68 | 1.937 | 0.114 |
| SNR × Processing | 10 | 170 | 0.992 | 0.452 |
| Level × Processing | 10 | 170 | 4.716 | <.001* |
| Talker × SNR × Level | 4 | 68 | 0.403 | 0.806 |
| Talker × SNR × Processing | 10 | 170 | 0.677 | 0.745 |
| Talker × Level × Processing | 10 | 170 | 0.832 | 0.535 |
| SNR × Level × Processing | 20 | 340 | 1.323 | 0.161 |
| Talker × SNR × Level × Proc | 20 | 340 | 1.015 | 0.443 |

Table 7

Results of the 4-way repeated measures ANOVA for the normalized quality ratings. If Mauchly's test of sphericity was significant, Greenhouse-Geisser adjusted values are reported. Significant results are indicated by an asterisk.

Fig. 17

| SNR, dB | Level, dB SPL | | | |
|---|---|---|---|---|
| | 75 | 65 | 55 | Average |
| No Noise | 0.661 | 0.872 | 0.774 | 0.769 |
| 15 | 0.455 | 0.602 | 0.491 | 0.516 |
| 5 | 0.261 | 0.401 | 0.315 | 0.326 |
| Average | 0.459 | 0.625 | 0.527 | |

Table 8

Normalized quality ratings averaged over listener, talker, and processing.

Fig. 18

| Factor | df | df (error) | 75 dB SPL | | 65 dB SPL | | 55 dB SPL | |
|---|---|---|---|---|---|---|---|---|
| | | | F | p | F | p | F | p |
| Talker | 1 | 17 | 0.051 | 0.824 | 0.129 | 0.724 | 0.323 | 0.577 |
| SNR | 2 | 34 | 52.48 | <.001* | 95.01 | <.001* | 146.4 | <.001* |
| Processing | 5 | 85 | 2.757 | 0.055 | 3.134 | 0.012* | 4.948 | 0.001* |
| Talker × SNR | 2 | 34 | 0.012 | 0.988 | 0.100 | 0.905 | 0.729 | 0.435 |
| Talker × Processing | 5 | 85 | 0.669 | 0.648 | 1.013 | 0.415 | 1.217 | 0.308 |
| SNR × Processing | 10 | 170 | 0.233 | 0.951 | 1.750 | 0.074 | 1.597 | 0.111 |
| Talker × SNR × Proc | 10 | 170 | 1.038 | 0.403 | 0.834 | 0.597 | 0.822 | 0.543 |

Table 9

Results of the 3-way repeated measures ANOVA for the normalized quality ratings. If Mauchly's test of sphericity was significant, Greenhouse-Geisser adjusted values are reported. Significant results are indicated by an asterisk.

Fig. 19

| SNR, dB | Processing | | | | | |
|---|---|---|---|---|---|---|
| | NAL-R | NAL-NL1 | QL 15 | QL 7.5 | MinCR 15 | MinCR 7.5 |
| No Noise | 0.892 | 0.939 | 0.922 | 0.950 | 0.947 | 0.933 |
| 15 | 0.917 | 0.958 | 0.950 | 0.911 | 0.923 | 0.903 |
| 5 | 0.781 | 0.789 | 0.814 | 0.883 | 0.842 | 0.817 |

Table 10

Intelligibility proportion keywords correct averaged over listener and talker for speech at 55 dB SPL

Fig. 20

HEARING AID WITH IMPROVED COMPRESSION

RELATED APPLICATION DATA

This application claims priority to and the benefit of Danish Patent Application No. PA 2012 70210, filed on Apr. 25, 2012, pending, and European Patent Application No. EP 12165500.5, filed on Apr. 25, 2012, pending, the disclosures of both of which are expressly incorporated by reference herein.

FIELD

The present application relates to a hearing aid with improved compression.

BACKGROUND

Multichannel wide dynamic-range compression (WDRC) processing has become the norm in modern digital hearing aids. WDRC can be considered in the light of two contradictory signal-processing assumptions. One assumption is that compression amplification will improve speech intelligibility because it places more of the speech above the impaired threshold. The opposing assumption is that compression amplification will reduce speech intelligibility because it distorts the signal envelope, reducing the spectral and temporal contrasts in the speech. The first assumption is used to justify fast time constants (syllabic compression) and more compression channels, while the second assumption is used to justify slow time constants (automatic gain control, or AGC) and fewer channels. Fast compression and a large number of narrow frequency channels maximizes audibility but increases distortion, while slow compression using a reduced number of channels minimizes distortion but provides reduced audibility.

An additional assumption in most WDRC systems is that the entire audible intensity range must be compressed to fit within the residual dynamic range of the hearing-impaired listener. This assumption, for example, is the basis of compression systems that use loudness scaling in an attempt to match the loudness of sound perceived by the impaired ear to that perceived by a normal ear.

A hearing aid with a compressor having a low and gain independent delay and low power consumption is disclosed in EP 1 448 022 A1.

A hearing aid with a compressor in which attack and release time constants are adjusted in response to input signal variations is disclosed in WO 06/102892 A1.

A summary of previous compression studies has shown that there are many conditions where linear amplification yields higher intelligibility and higher speech quality than compression. Simulation results indicate that linear amplification give higher intelligibility and higher quality than compression as long as the speech is sufficiently above the impaired threshold. Compression gives substantially better predicted intelligibility and quality only for the condition of low signal levels combined with a moderate/severe hearing loss.

SUMMARY

Thus, there is a need of a method of hearing loss compression with an improved compression scheme.

A new method of hearing loss compression with an improved compression scheme is provided based on the realisation that the dynamic range of speech is much less than the entire auditory dynamic range. The classical assumption is that the dynamic range of speech is 30 dB, although more recent studies using digital instrumentation have found a dynamic range of 40 to 50 dB.

Therefore, in order to reduce distortion while maintaining audibility, the speech dynamic range rather than the entire normal auditory dynamic range is fitted to the impaired ear.

With the new method, both intelligibility and quality are improved by varying the hearing-aid amplification in response to the signal characteristics and not just to the hearing loss.

Accordingly, a new method is provided of hearing loss compensation with a hearing aid comprising a microphone for conversion of acoustic sound into an input audio signal, a signal processor for processing the input audio signal for generation of an output audio signal, the signal processor including a compressor, and a transducer for conversion of the output audio signal into a signal to be received by a human, the method comprising the steps of:

fitting the compressor input/output rule in accordance with the hearing loss of the intended user, and varying the compressor input/output rule in response to a signal level of the audio input signal.

In this way, an improved hearing-aid amplification procedure is provided based on interaction of hearing loss and signal level.

The compressor operates to adjust its gain in response to the input signal level. The signal level may for example be determined using a peak detector. The peak detector output is then used to determine the compressor gain. The transformation that gives the signal output level as a function of the input signal level is termed the compressor input/output rule. The compressor input/output rule is normally plotted giving the output level as a function of the input level. However, the detector of the input signal level, such as the above-mentioned peak detector, may differ substantially from the instantaneous input signal level during rapid changes of the input signal. Thus, the compressor input/output rule as normally plotted is accurate only for steady-state signals.

Many different procedures have been developed for fitting hearing aids. For example, the NAL-R procedure is used for linear frequency response setting. NAL-R is based on adjusting the amplified speech to achieve the most comfortable listening level (MCL) as a function of frequency, with the goal of providing good speech audibility while maintaining listener comfort. An extension of this linear fitting rule that provides amplification targets for profound losses, NAL-RP, is also available.

NAL-NL1 is another well-known fitting procedure. NAL-NL1 is a threshold-based procedure that prescribes gain-frequency responses for different input levels, or the compression ratios at different frequencies, in wide dynamic range compression hearing aids. The aim of NAL-NL1 is to maximize speech intelligibility for any input level of speech above the compression threshold, while keeping the overall loudness of speech at or below normal overall loudness. The formula is derived from optimizing the gain-frequency response for speech presented at 11 different input levels to 52 different audiogram configurations on the basis of two theoretical formulas. The two formulas consisted of a modified version of the speech intelligibility index calculation and a loudness model by Moore and Glasberg (1997).

A compression input/output rule for one frequency band is shown in FIG. 3. The signal level is detected using a peak detector. Inputs below the lower knee point of 45 dB SPL have linear amplification to prevent over-amplifying background noise. Inputs above 100 dB SPL are subjected to compression limiting to prevent exceeding the listener's loudness discomfort level (LDL). In between the knee points, the signal is compressed, with the gain decreasing as the peak-detected signal level increases. The compression ratio CR is specified in terms of g50, the gain for an input at 50 dB SPL, and g80, the gain for an input at 80 dB SPL:

$$CR = \frac{1}{1 + (g80 - g50)/30} \quad (1)$$

A new hearing aid utilizing the new method is also provided, the new hearing aid comprising a microphone for conversion of acoustic sound into an input audio signal, a signal processor for processing the input audio signal for generation of an output audio signal, the signal processor including a compressor, a transducer for conversion of the output audio signal into a signal to be received by a human, wherein:

the compressor input/output rule is variable in response to a signal level of the audio input signal; for example, a compression ratio of the compressor may be variable in response to the signal level of the audio input signal.

The compressor input/output rule may be variable in response to an estimated signal dynamic range of the audio input signal.

The hearing aid may comprise a valley detector for determination of a minimum value of the input audio signal, and a first gain value of the compressor may be increased for a selected first signal level if the determined minimum value times a compressor gain at the determined minimum value times is less than the hearing threshold.

Likewise, the first gain value of the compressor for the selected first signal level is decreased if the determined minimum value times the compressor gain at the determined minimum value times is greater than the hearing threshold.

The hearing aid may further comprise a peak detector for determination of a maximum value of the input audio signal, and a second gain value of the compressor may be increased for a selected second signal level if the determined maximum value times a compressor gain at the determined maximum value is less than a pre-determined allowable maximum level, such as the loudness discomfort level Likewise, the second gain value of the compressor for a selected second signal level is decreased if the determined maximum value times the compressor gain at the determined maximum value is greater than the pre-determined allowable maximum level, such as the loudness discomfort level.

The first gain value may be limited to a specific first maximum value so that the first gain value can not be increased above the specific first maximum value.

Likewise, the second gain value may be limited to a specific second maximum value so that the second gain value can not be increased above the specific second maximum value.

The hearing aid including the processor may further be configured to process the signal in a plurality of frequency channels, and the compressor may be a multi-channel compressor, wherein the compressor input/output rule is variable in response to the signal level in at least one frequency channel of the plurality of frequency channels, for example in all of the frequency channels.

The plurality of frequency channels may include warped frequency channels, for example all of the frequency channels may be warped frequency channels.

According to the new method of hearing loss compensation, the shape of the gain of the hearing aid as a function of frequency is kept close to the listener's preferred response since changes in frequency response can reduce speech quality.

Further, since time-varying amplification also reduces speech quality, the amount of compression consistent with achieving the desired audibility target is also minimized.

The overall processing approach of the new method is to use linear amplification when that provides sufficient gain to place the speech above the impaired hearing threshold. If the linear amplification provides insufficient gain, then the gain is slowly increased or a minimal amount of dynamic-range compression is introduced to restore audibility. For example, the gain in each frequency band may be slowly adjusted to place the estimated speech minima within that band at or above the impaired auditory threshold.

For high-intensity signals, the shape of hearing aid gain as a function of frequency may be kept at that recommended by the NAL-R fitting rule, while the gain for low-level signals in each frequency band is increased to ensure that the estimated speech minima are above the impaired auditory threshold resulting in a small amount of compression using a compression input/output rule that varies slowly over time.

In accordance with some embodiments, a hearing aid includes a microphone for conversion of acoustic sound into an input audio signal, a signal processor for processing the input audio signal for generation of an output audio signal; and a transducer for conversion of the output audio signal into a signal to be received by a human, wherein the signal processor includes a compressor with a compressor input/output rule that is variable in response to a signal level of the input audio signal.

In accordance with other embodiments, a method of hearing loss compensation with a hearing aid comprising a microphone for conversion of acoustic sound into an input audio signal, a signal processor for processing the input audio signal for generation of an output audio signal, the signal processor including a compressor, and a transducer for conversion of the output audio signal into a signal to be received by a human, includes: fitting the compressor input/output rule in accordance with a hearing loss of a user, and varying the compressor input/output rule in response to a signal level of the input audio signal.

Other and further aspects and features will be evident from reading the following detailed description of the embodiments.

BRIEF DESCRIPTION OF THE DRAWINGS

Below, the embodiments will be described in more detail with reference to the exemplary binaural hearing aid systems in the drawings, wherein

FIG. 11 shows Table 1, FIG. 12 shows Table 2, FIG. 13 shows Table 3, FIG. 14 shows Table 4, FIG. 15 shows Table 5, FIG. 16 shows Table 6, FIG. 17 shows Table 7, FIG. 18 shows Table 8, FIG. 19 shows Table 9, and FIG. 20 shows Table 10.

DETAILED DESCRIPTION OF PREFERRED EMBODIMENTS

Figure 1:
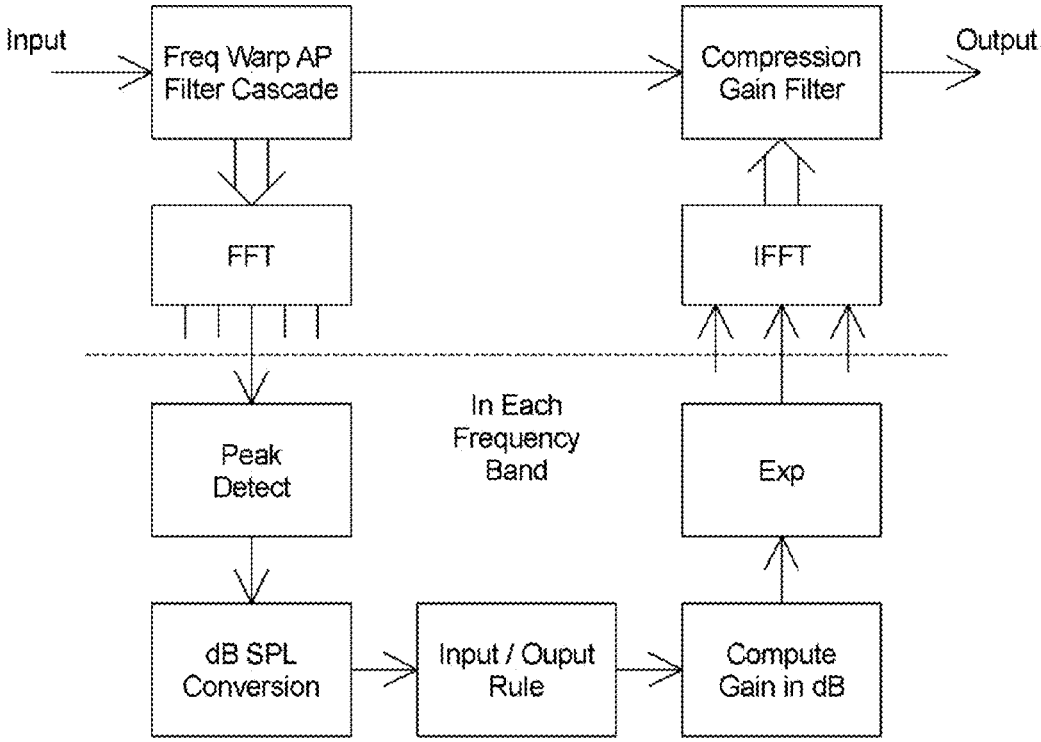
FIG. 1 is a block diagram of a conventional hearing aid compressor using digital frequency warping. The compression gain is computed in each frequency band and applied to a linear time-varying filter.

The new hearing aid will now be described more fully hereinafter with reference to the accompanying drawings, in which various examples are shown. The accompanying drawings are schematic and simplified for clarity. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. Thus, the appended patent claims may be embodied in different forms not shown in the accompanying drawings and should not be construed as limited to the examples set forth herein. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or even if not so explicitly described.

The traditional approach to wide dynamic-range compression is shown in FIG. 1. A compression input/output rule is configured at the hearing-aid fitting, and that rule then remains in place without change. The compression rule establishes the signal intensity range that is to be compressed and the compression ratio to be used.

Figure 2:
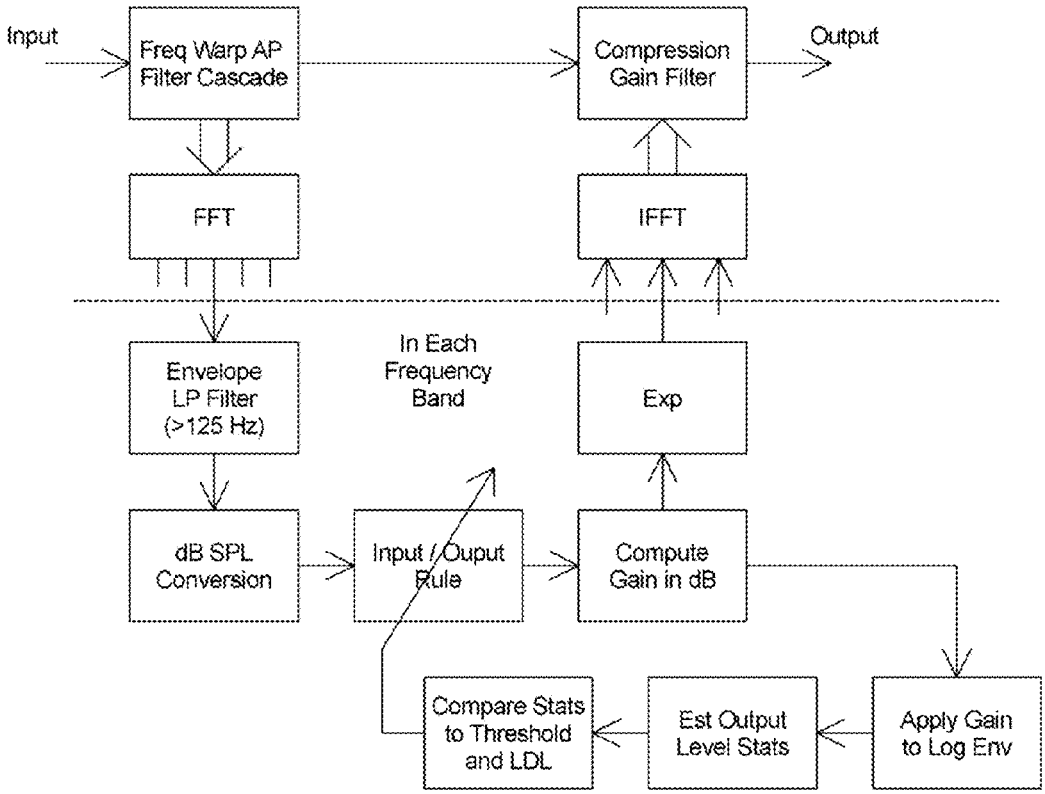
FIG. 2 is a block diagram of a new multi-channel compressor using digital frequency warping.

One approach used according to the new method and in the new hearing aid is shown in FIG. 2.

The input/output rule used for the amplification is variable in response to the estimated signal dynamic range. If the amplified signal fits within the listener's available auditory dynamic range, then the input/output rule stays constant. If the average level of the speech minima drops below the impaired auditory threshold, the input/output rule is modified to provide more low-level gain. If the amplified signal peaks exceed the loudness discomfort level (LDL), the gain is reduced. When compression is needed to reduce the signal dynamic range to fit within the listener's available auditory dynamic range, the compression ratio used is the smallest that can accomplish this goal.

The compressor architecture shown in FIG. 1 is used in the GN ReSound family of hearing aids. The system uses a cascade of all-pass filters to delay the low frequencies of the signal relative to the high frequencies. The corresponding frequency analysis, which is implemented using a fast Fourier transform (FFT), has better frequency resolution at low frequencies and poorer resolution at high frequencies than a conventional FFT, and the overall frequency resolution approximately matches that of the human ear.

In the illustrated example, the gain values are updated once each signal block, with the block size set to 32 samples (1.45 ms) at the 22.05 kHz sampling rate. The warped filter cascade has 31 first-order all-pass filter sections, and a 32-point FFT is used to give 17 frequency analysis bands from 0 to 11.025 kHz. The all-pass filter parameter a, which controls the amount of delay at low frequencies relative to high frequencies, is set to a=0.646 to give an optimal fit of the warped frequency axis to critical-band auditory filter spacing. The compression gains are determined in the frequency domain, transformed into to an equivalent warped time-domain filter, and the input signal is then convolved with this time-varying filter to give the amplified output. The centre frequencies of the frequency analysis bands are listed in Table 1. In the 17-channel compressor, an independent compression channel is assigned to each of the warped FFT analysis bands.

In the following, one example of the new method is denoted Quasi-Linear (QL) compression. The logic flowchart for the Quasi-Linear algorithm is presented in Table 2. The NAL-R prescription is used as the listener's preferred frequency response. The gain calculations are independent in each frequency band; the overall frequency response can therefore deviate from NAL-R, but the algorithm slowly converges back to the NAL-R gain in each frequency band if the amplified signal in that band is above threshold. If the estimated signal minimum in a given frequency band falls below the auditory threshold the gain in that band is increased at a rate of $\alpha$ dB/sec. If the estimated peak level exceeds LDL, the gain is reduced at a rate of $\beta$ dB/sec, with a giving 2.5 dB/sec and $\beta$ giving 5 dB/sec.

The peak and valley levels are estimated by adding the gain in dB determined for the previous signal block to the signal level in dB computed for the present block, and then applying the peak and valley detectors within each frequency band. As long as the measured dynamic range of the signal falls within the residual dynamic range of the impaired ear, both g50 and g80 are increased or decreased by the same amount and the response below the upper knee point remains linear. Compression is invoked only if the minima fall below threshold while the peaks simultaneously lie above LDL. In this case the signal dynamic range exceeds the listener's available dynamic range and g50 is increased while g80 is decreased.

As indicated in the paragraph above, the QL algorithm requires estimates of the listener's LDL in addition to the auditory threshold. The LDL may be estimated from the auditory threshold at each frequency. For example, if the loss is less than 60 dB at a given frequency, the LDL is set to 105 dB SPL. For losses exceeding 60 dB, the LDL is set to 105 dB SPL plus half of the loss in excess of 60 dB SPL.

Once the compression input/output rule has been established via the variable g50 and g80 values, the incoming signal is compressed. The signal compression is based on the output of a separate level detector. This level detector comprised a low-pass filter having a time constant of 5 msec, so it is nearly instantaneous. The choice of very fast compression leads to the highest intelligibility and quality for speech at 55 dB SPL for listeners having moderate/severe losses. The lower compression knee point is located at 45 dB SPL and the upper knee point at 100 dB SPL.

Figure 3:
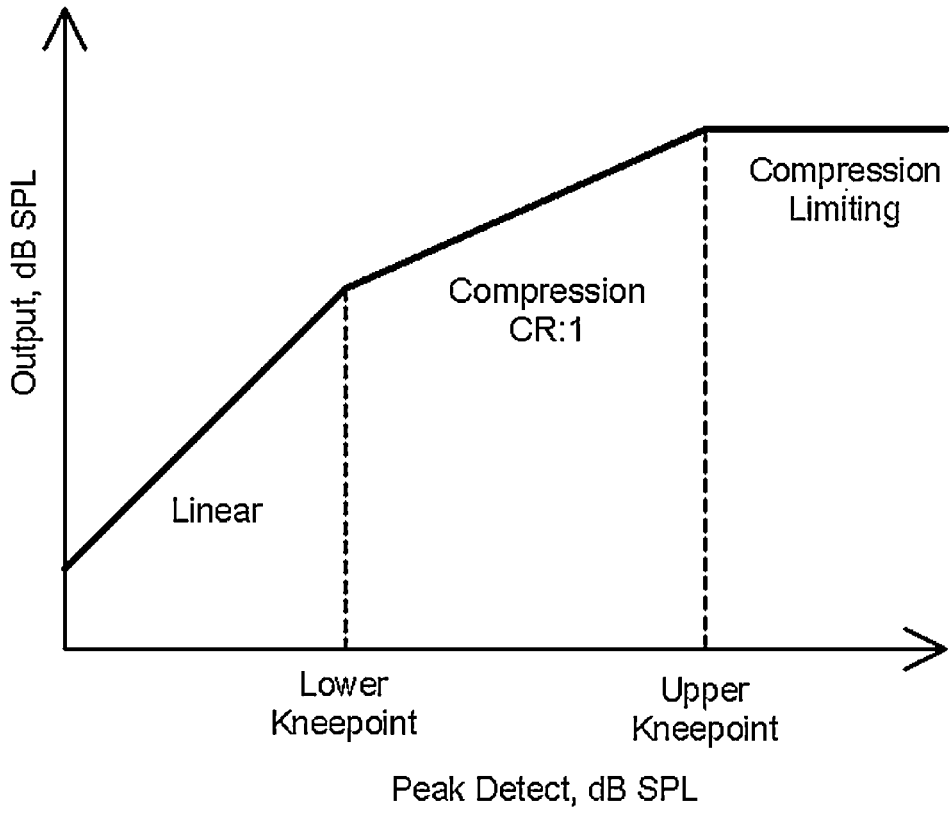
FIG. 3 shows an example of a compressor input/output rule.

The QL algorithm may have three sets of time constants: 1) The attack and release times used to detect the signal peaks and valleys, 2) The rate at which g50 and g80 is varied in response to the signal peak and valley estimates, and 3) The rate at which the signal dynamics are actually modified using the compressor input/out rule as for example shown in FIG. 3, when compression is needed. The peak levels for varying g50 and g80 are estimated using an attack time of 5 ms and a release time of 125 ms in all frequency bands. The valley levels are estimated using a valley detector with an attack time of 12.5 ms and a release time of 125 ms in all frequency bands. Once the estimates of the peaks and valleys have been made, the values of g50 and g80 are incremented or decremented based on the rates given by $\alpha$ and $\beta$. At the same time, the signal level is estimated using a 5-msec time constant, and this estimate forms the input to the compression rule. Compression occurs, however, only if indicated by the slope of the input/output function specified by g50 and g80.

The QL algorithm also varies the amplification in response to the background noise level. The value of g50 is established by the output of the valley detector. This output level increases as the noise level increases. In the absence of noise, the QL algorithm places the average speech minima at or above the impaired auditory threshold. When noise is present, the algorithm tends to place the noise level at auditory threshold, which results in a decrease in gain compared to speech in quiet. The QL algorithm thus implicitly contains noise suppression since the gain when noise is present is lower than the gain when noise is absent.

In the following, another example of the new method is denoted Minimum Compression Ratio (MinCR).

The Minimum Compression Ratio (MinCR) algorithm is similar to the Quasi-Linear algorithm except that the gain for an input at 100 dB SPL (g100) is fixed at the NAL-R response value. The logic flowchart for the Minimum Compression Ratio algorithm is presented in Table 3. Only g50 is variable in response to the estimated signal minima. The minima are estimated by adding the gain in dB determined for the previous signal block to the signal level in dB in the present block, and then applying the valley detector.

If the estimated minima fall below the auditory threshold, the g50 gain is increased at a rate of a dB/sec, where $\alpha$ is 2.5 dB/sec. If the estimated minima exceed the auditory threshold, then the g50 gain is nudged towards the NAL-R value using the same value of $\alpha$=2.5 dB/sec.

This system gives an input/output rule like the one shown in FIG. 3. However, instead of using fixed compression ratios as is done in NAL-NL1, the MinCR algorithm varies the compression ratio to give the smallest amount of compression consistent with placing the speech minima at the impaired auditory threshold. Thus, the compression ratio is typically lower than that prescribed by NAL-NL1, but the new algorithm still succeeds in maintaining the audibility of the speech. However, the shape of the frequency response may deviate from NAL-R, especially at high frequencies where NAL-R prescribes less gain than needed for complete audibility in order to preserve listener comfort.

The MinCR algorithm may have three sets of time constants: 1) The attack and release times used to detect the signal valleys, 2) The rate at which g50 is varied in response to the signal valley estimate, and 3) The rate at which the signal dynamics are actually modified using the compression rule. The attack and release time for tracking the signal valleys can be the same as for the QL compressor above. The value of g50 may then be varied at a dB/sec. Once the compression input/output rule has been established, the incoming signal is compressed based on the peak detector output exactly as is done in the NAL-NL1 compression system. The same attack and release times as in NAL-N1 may be used, giving syllabic compression. The lower compression knee point is located at 45 dB SPL and the upper knee point at 100 dB SPL.

The MinCR algorithm, like the QL algorithm, varies the gain in response to the background noise level. The value of g50, as in the QL algorithm, is set by the output of the valley detector. In the absence of noise, the value of g50 is controlled by the speech minima. When noise is present the estimated speech minimum level increases, requiring less gain to place the minimum at the impaired auditory threshold and resulting in a reduced compression ratio compared to speech in quiet. Thus, like the QL approach, the MinCR algorithm implicitly contains noise suppression since the gain when noise is present is lower than the gain when noise is absent. The change in the MinCR gain in response to noise differs from NAL-NL1, which uses the same compression ratios for signals in noise as for quiet.

The gain required to place the speech minima at the impaired auditory threshold in the QL and MinCR algorithms could become uncomfortably large for large hearing losses. This is particularly true for high-frequency losses; for example NAL-R provides less gain than needed for audibility at high frequencies in order to maintain listener comfort. The deviation from NAL-R is controlled by establishing a maximum allowable increase above the NAL-R response, denoted by gMax(f). If the maximum deviation in a frequency band is set to 0 dB, the system is forced to maintain the NAL-R gain in that band. If no maximum is set, the gain can increase without limit in the band. The speech audibility will then be higher than for NAL-R, but the quality may go down as the frequency response shifts away from NAL-R. Two settings of gMax(f) may be used. For example a larger setting of 15 dB above the NAL-R response at mid frequencies that is gradually reduced to 7.5 dB above NAL-R response at frequencies below 150 and above 2000 Hz. The smaller setting is half the larger as expressed in dB. Below, the gMax(f) setting is indicated by a number following the algorithm abbreviation. For example, QL 7.5 indicates the QL algorithm with the maximum mid-frequency gain limited to 7.5 dB above NAL-R.

Figure 4:
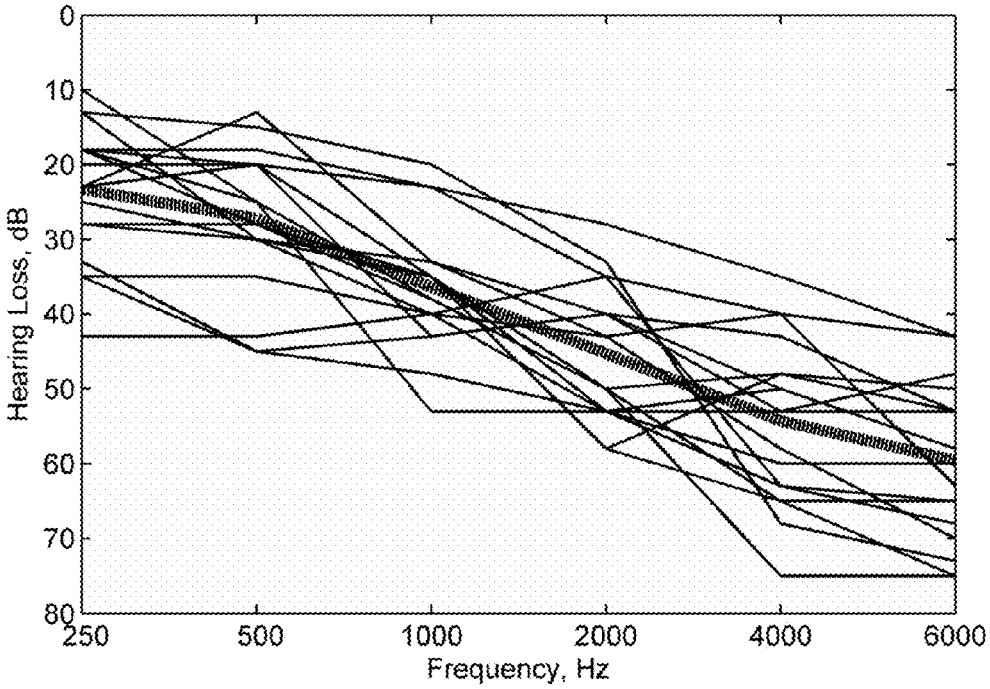
FIG. 4 shows plots of subject audiograms. The average hearing loss is given by the heavy dashed line, while the individual audiograms are given by the thin solid lines.

For comparing the new method of hearing loss compensation with conventional compression, a test group comprised 18 individuals with moderate hearing loss. The audiograms are plotted in FIG. 4. The subjects were drawn from a pool of individuals who have made themselves available for clinical hearing-aid trials at GN ReSound in Glenview, Ill. All members of the test group had taken part in previous field trials of prototype hearing aids, and many of the subjects had experience in clinical intelligibility testing. Seven members of the group were bilateral hearing-aid wearers and the remaining eleven members did not own hearing aids. However, many of the subjects continue from one study to the next so they might be aided for months at a time even if they don't own their own hearing aids. The mean age of the group was 72 years (range 56-82 years). Participants were reimbursed for their time. IRB approval was not needed for the experiment; however, each participant was presented with a consent form and the risks of participating were clearly explained. In addition, the subjects could withdraw from the study at any time without penalty.

All participants had symmetrical hearing thresholds (pure-tone average difference between ears less than 10 dB), air-bone gaps of 10 dB or less at octave frequencies from 0.25-4 kHz, and had normal tympanometric peak pressure and static admittance in both ears. All participants spoke English as their first or primary language.

Speech intelligibility test materials consisted of two sets of 108 low-context sentences drawn from the IEEE corpus. One set was spoken by a male talker, and the second set was spoken by a female talker. Speech quality test materials comprised a pair of sentences drawn from the IEEE corpus and spoken by the male talker ("Take the winding path to reach the lake." "A saw is a tool used for making boards.") and the same pair of sentences spoken by the female talker. All of the stimuli were digitized at a 44.1 kHz sampling rate and down sampled to 22.05 kHz to approximate the bandwidth typically found in hearing aids.

The sentences were processed using the NAL-R, NAL-NL1, and the new WDRC procedures described in the previous section. The speech was input to the processing using three different amounts of stationary speech-shaped noise: no noise, a signal-to-noise ratio (SNR) of 15 dB, and a SNR of 5 dB. A separate noise spectrum was computed to match the long-term spectrum of each sentence. In addition to the three SNRs, three different speech intensities were used. Conversational speech was represented using 65 dB SPL, while soft speech was represented by 55 dB SPL and loud speech by 75 dB SPL. Since the loud speech was created by increasing the amplification for speech produced at normal intensity, there was no change in apparent vocal effort. In each case, the speech level was fixed at the desired intensity and the noise added to create the desired SNR. The total number of conditions for each talker was therefore 3 input levels×3 SNRs×6 processing types=54 conditions.

The stimuli for each listener were generated off-line using a MATLAB program adjusted for the individual's hearing loss. The signal processing in MATLAB was performed at the 22.05-kHz sampling rate, after which the signals were up sampled to 22.414 kHz for compatibility with the Tucker-Davis laboratory equipment. The digitally-stored stimuli were then played back during the experimental sessions. The listener was seated in a double-walled sound booth. The stored stimuli were routed through a digital-to-analogue converter (TDT RX8) and a headphone buffer (TDT HB7) and were presented diotically to the listeners test ears through Sennheiser HD 25-1 II headphones. In the situation where the listeners did not have identical audiograms for the two ears, the processing parameters were set for the average of the loss at the two ears.

On each intelligibility trial, listeners heard a sentence randomly drawn from one of the test conditions. The test materials comprised 108 sentences (54 processing conditions×2 repetitions) for one talker gender in one test block and the 108 sentences for the other talker gender in a second test block. The timing of presentation was controlled by the subject. There were not any practice sentences, and no feedback was provided. The intelligibility data thus represent a listener's first response to encountering the new compression algorithms. No sentence was repeated and the random sentence selection and order was different for each listener. The order of talker (male first or female first) was also randomized for each listener. The listener repeated the sentence heard. Scoring was based on keywords correct (5 per sentence). Scoring was completed by the experimenter seated outside the sound booth, and the response was verified at the time of testing. The listener instructions are reproduced in Appendix A.

Speech quality was rated within one block of sentences for the male talker and a second block for the female talker. There were not any practice sentences, but the quality rating sessions were conducted after the intelligibility tests so the subjects were already familiar with the range of processed materials. To ensure that the subjects understood the test procedure, they were asked to repeat back the directions prior to the initiation of the test. Several subjects reported not understanding what "sound quality" meant and equated it with "loudness". In these instances, subjects were given the instruction to read again so that "sound quality" was clearly understood.

The test materials comprised the 108 sentences for one talker gender in one test block and the 108 sentences for the other talker gender in a second test block. Within each test block, the same two sentences were used for all processing conditions to avoid confounding quality judgments with potential differences in intelligibility. Listeners were instructed to rate the overall sound quality using a rating scale which ranged from 0 (poor sound quality) to 10 (excellent sound quality) (ITU 2003). The rating scale was implemented with a slider bar that registered responses in increments of 0.5. Listeners made their selections from the slider bar displayed on the computer screen using a customized interface that used the left and right arrow keys for selecting the rating score and the mouse for recording and verifying rating scores. The timing of presentation was controlled by the subject. Responses were collected using a laptop computer. The tester was seated next to the subject during testing because some subjects were unable to independently use the computer. In these cases, the tester operated the computer and entered each response as indicated by the subject. Note that the tester was blind to the order of stimulus presentation and could not hear the stimuli being presented to the subject. No feedback was provided. The listener instructions are reproduced in Appendix A.

Figure 5:
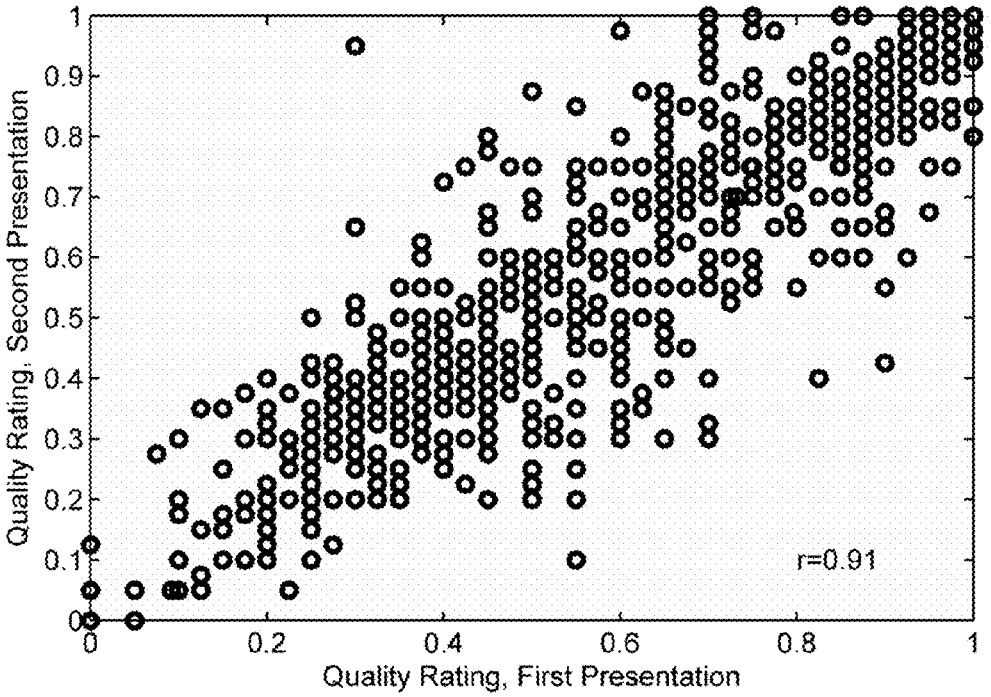
FIG. 5 shows a scatter plot of the subject quality ratings comparing the responses for the first presentation of a stimulus to the second presentation of the same stimulus. The ratings are averaged over talker.

Listeners participated in four sessions for the intelligibility tests and four sessions for quality ratings. In the four sessions the subjects provided responses for the entire stimulus set twice for each talker (male and female). To quantify how consistent the subjects were in their responses, the quality ratings averaged across the male and female talkers for the first presentation of the materials were compared to the averaged ratings for the second presentation. Intelligibility scores have not been compared across repetitions because each session used a different random subset of the IEEE sentences. A scatter plot of the across-session quality ratings is presented in FIG. 5. Each data point represents one subject's rating of one combination of signal level, SNR, and type of processing for the first presentation of the stimulus compared to the rating for the second presentation of the same stimulus. The subjects demonstrated consistent quality ratings across presentations, with a Pearson correlation coefficient between the first presentation and second presentation ratings of $r=0.910$. This degree of correlation compares favourably with test-retest correlations in previous experiments involving hearing-impaired listeners. Given the high correlation between sessions, the data in the present disclosure were averaged across presentation for the remaining analyses.

Figure 6:
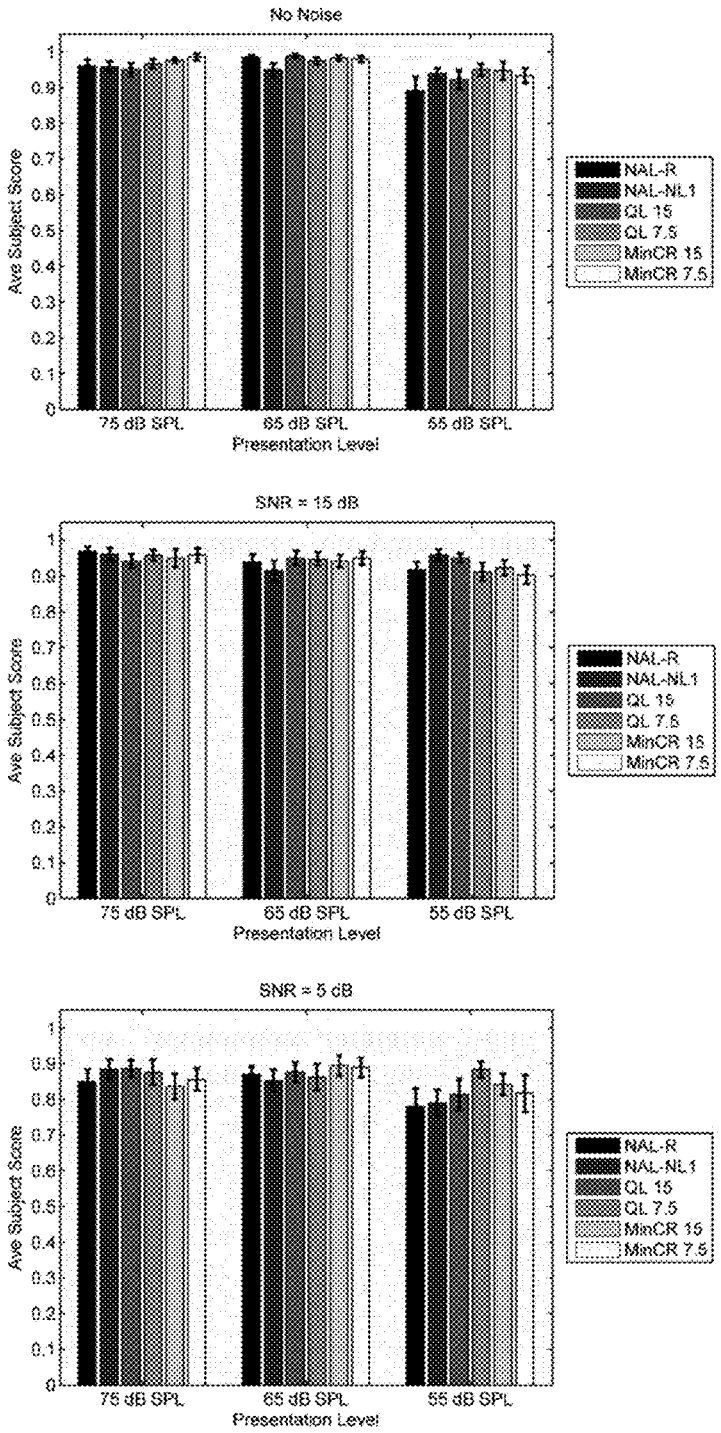
FIG. 6 shows intelligibility scores (proportion keywords correct) averaged over talker.

The intelligibility scores, expressed as the proportion keywords correct, are plotted in FIG. 6. The scores have been averaged over listener and talker. The results for no noise are in the top panel, the results for the SNR of 15 dB are in the middle panel, and the results for 5 dB are in the bottom panel. The error bars indicate the standard error of the mean.

One pattern visible in the data is the relationship between NAL-R and NAL-NL1 as the SNR and level are varied. For speech at 65 dB SPL, the linear processing provided by NAL-R gives higher intelligibility than the compression provided by NAL-NL1 for all three SNRs. However, the opposite is true for speech at 55 dB SPL, where NAL-NL1 gives higher intelligibility than NAL-R for all three SNRs. The results are mixed for speech at 75 dB SPL.

The new algorithms (QL 15, QL 7.5, MinCR 15, and MinCR 7.5) give intelligibility comparable to NAL-R for speech at 65 dB SPL and intelligibility comparable to NAL-NL1 for speech at 55 dB SPL. The one exception is for speech at 55 dB SPL and an SNR of 5 dB, where the QL 7.5 algorithm gives much better intelligibility than either NAL-R or NAL-NL1. The results for the new algorithms are similar to those for NAL-R and NAL-NL1 for speech at 75 dB SPL.

For statistical analysis, the intelligibility scores were arcsine transformed to compensate for ceiling effects. A four-factor repeated measures analysis of variance (ANOVA) was conducted. The factors were talker, SNR, level of presentation, and type of processing. The ANOVA results are presented in Table 4. Talker and processing are not significant, while SNR and level are significant factors. None of the interactions involving processing are significant, while the interaction of talker and level and the interaction of talker, SNR, and level are both significant.

The effects of SNR and level are summarized in Table 5. The table presents the speech intelligibility averaged over listener, talker, and processing. The effects of SNR, averaged over level, are given by the marginal in the right-most column. Adding a small amount of noise to give a SNR of 15 dB causes only a small reduction in intelligibility, while there is a substantial reduction in intelligibility when the SNR is reduced to 5 dB. The effects of level, averaged over SNR, are given by the marginal across the bottom. There is essentially no difference in intelligibility for speech at 75 and 65 dB SPL, while there is a noticeable reduction in intelligibility for speech at 55 dB SPL.

Figure 7:
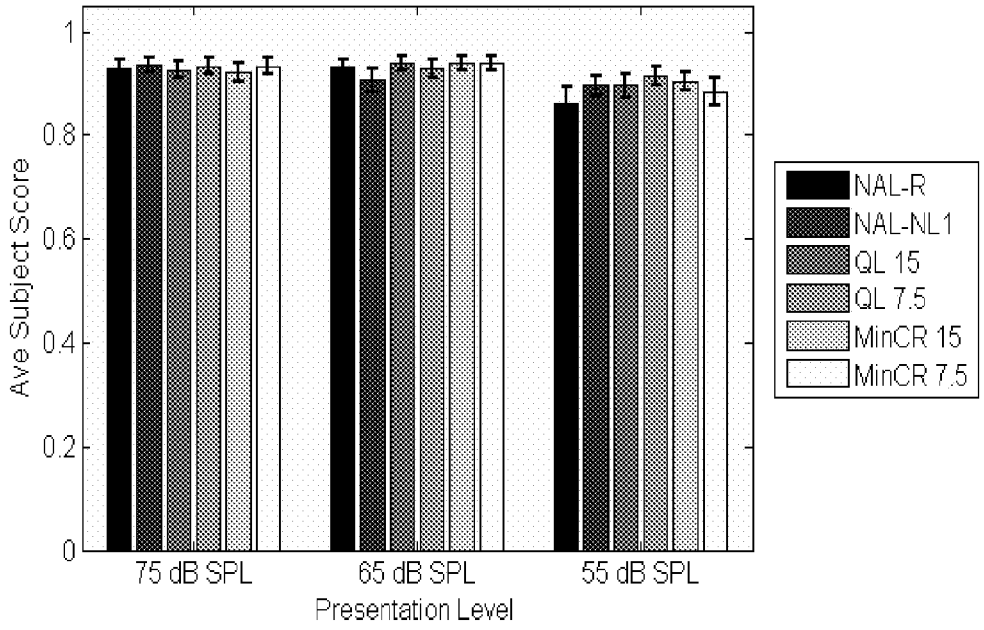
FIG. 7 shows intelligibility scores (proportion keywords correct) averaged over listener, talker, and SNR.

The effects of level are illustrated in FIG. 7. The ratings have been averaged over listener, talker, and SNR. At 65 dB SPL, the NAL-NL1 processing gives the lowest intelligibility while the performance of the new algorithms is comparable to NAL-R. At 55 dB SPL, NAL-R gives the lowest intelligibility and QL 7.5 gives the highest. The results for all of the processing approaches are comparable for speech at 75 dB SPL. However, none of these differences in processing are statistically significant at the 5 percent level.

Figure 8:
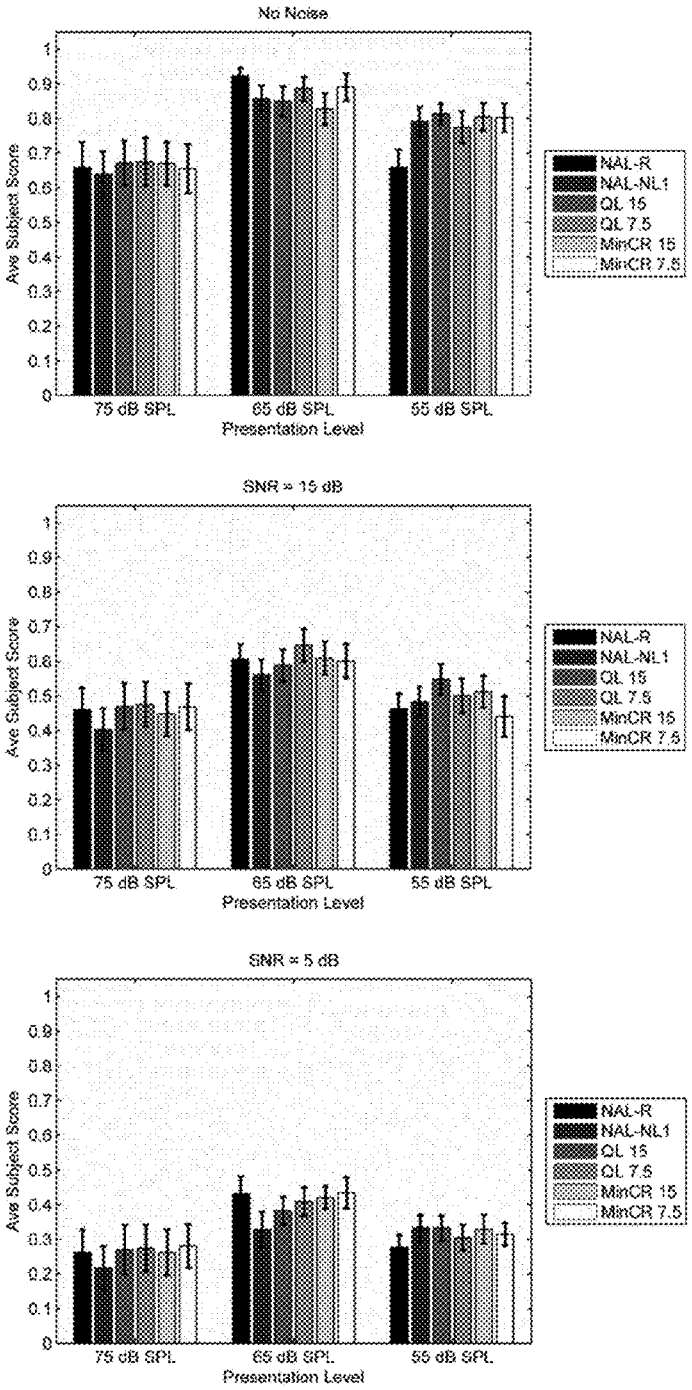
FIG. 8 shows normalized quality ratings averaged over talker.

The quality ratings are plotted in FIG. 8. The quality ratings have been normalized to the range of judgments used by each subject. The highest rating returned by a subject for each talker was set to 1, and the lowest rating was set to 0. The intermediate ratings for each talker for the subject were then scaled proportionately from 0 to 1. The normalization reduces individual bias that would result from using only a portion of the full rating scale. The plotted scores have been averaged over listener and talker. The results for no noise are in the top panel, the results for the SNR of 15 dB are in the middle panel, and the results for 5 dB are in the bottom panel. The error bars indicate the standard error of the mean.

As was the case for intelligibility, one pattern visible in the data is the relationship between NAL-R and NAL-NL1 as the SNR and level are varied. For speech at 65 dB SPL, the linear processing provided by NAL-R gives higher quality than the compression provided by NAL-NL1 for all three SNRs. However, the opposite is true for speech at 55 dB SPL, where NAL-NL1 gives higher quality than NAL-R for all three SNRs. Unlike the intelligibility results, there is also a preference for NAL-R over NAL-NL1 for speech at 75 dB SPL.

Two of the new algorithms, QL 7.5 and MinCR 7.5, give quality comparable to NAL-R for speech at 65 dB SPL with no noise, and all four of the new algorithms give quality comparable to NAL-NL1 for speech at 55 dB SPL with no noise. The QL 7.5 algorithm gives higher quality than NAL-R for SNR=15 dB and 65 dB SPL, while both QL algorithms and MinCR 15 give higher quality than NLA-NL1 for SNR=15 dB and speech at 55 dB SPL. For SNR=5 dB and speech at 65 dB SPL, the MinCR approaches are comparable to NAL-R, and when the speech is reduced to 55 dB SPL the QL15 and MinCR 15 algorithms give quality that is closest to NAL-NL1.

The statistical analysis used the normalized subject quality ratings. A four-factor repeated measures analysis of variance (ANOVA) was conducted. The factors were talker, SNR, level of presentation, and type of processing. The ANOVA results are presented in Table 7. Talker and processing are not significant, while SNR and level are significant. The interaction of level with processing is also significant.

The effects of SNR and level are summarized in Table 8. The table presents the speech quality averaged over listener, talker, and processing. The effects of SNR, averaged over level, are given by the marginal in the right-most column. Adding a small amount of noise to give a SNR of 15 dB causes a substantial reduction in quality, and there is an even greater reduction in quality when the SNR is reduced to 5 dB. The effects of level, averaged over SNR, are given by the marginal across the bottom. The quality is highest for speech at 65 dB SPL, and is noticeably reduced for either an increase or decrease in level.

Figure 9:
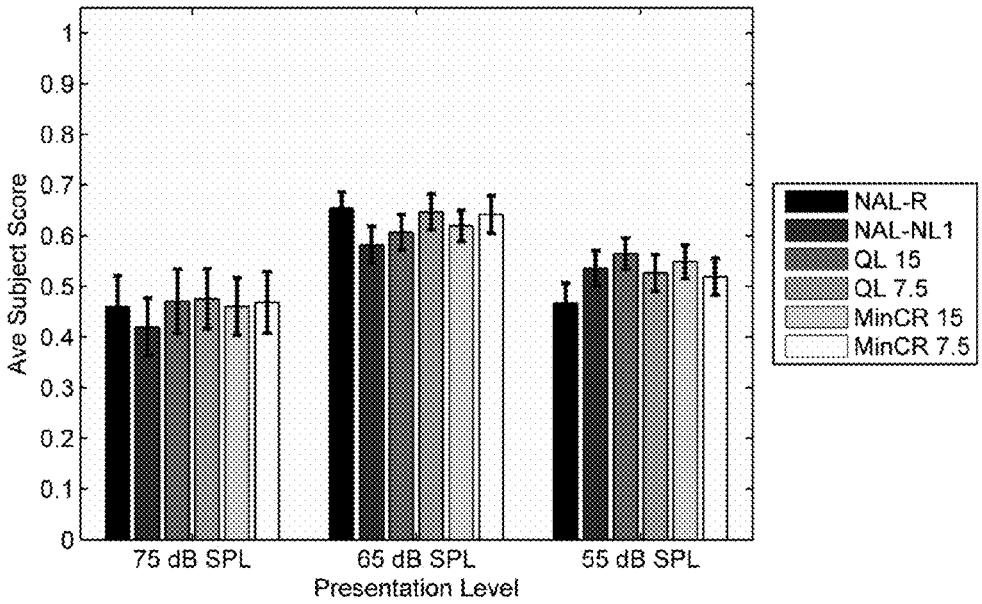
FIG. 9 shows normalized quality ratings averaged over listener, talker, and SNR.

The effects of level are illustrated in FIG. 9. The ratings have been averaged over listener, talker, and SNR. At 65 dB SPL, NAL-R gives higher intelligibility than NAL-NL1, while at 55 dB SPL the reverse is true. NAL-R gives the best quality at 65 dB SPL, but is closely matched by QL 7.5 and MinCR 7.5. The best quality at 55 dB SPL is for QL 15 and MinCR 15, while NAL-R is the worst. NAL-R is also better than NAL-NL1 for speech at 75 dB SPL. All four implementations of the new algorithms for speech at 75 dB SPL give quality ratings that are comparable to slightly better than NAL-R, while NAL-NL1 is the worst.

The ANOVA of Table 7 shows a statistically significant interaction between level and processing. This interaction is explored in Table 9, which presents repeated-measures ANOVA results for each level of signal presentation with talker, SNR, and processing as factors. For speech at 75 dB SPL the type of processing is not quite significant, and an analysis of the pair-wise comparisons shows no significant differences between the processing algorithms. Processing is significant for speech at 65 dB SPL, and an analysis of the pair-wise comparisons shows that NAL-R is rated significantly higher than NAL-NL1 ($p=0.049$). There are no other significant differences between types of processing at this signal intensity. Processing is also significant for speech at 55 dB SPL. An analysis of the pair-wise comparisons shows that QL 15 is significantly better than NAL-R ($p=0.021$) and that MinCR 15 is also significantly better than NAL-R ($p=0.033$). The QL 7.5 algorithm is also better than NAL-R, but the difference is not quite significant ($p=0.065$).

The effects of processing, averaged over the other three factors of talker, SNR, and level, are summarized in Table 6 along with the intelligibility results. The QL and MinCR algorithms giving higher quality than NAL-R and NAL-NL1. The highest average quality is for QL 7.5, followed closely by QL 15 and both versions of MinCR. The lowest average quality is for the NAL-R and NAL-NL1 approaches.

Figure 10:
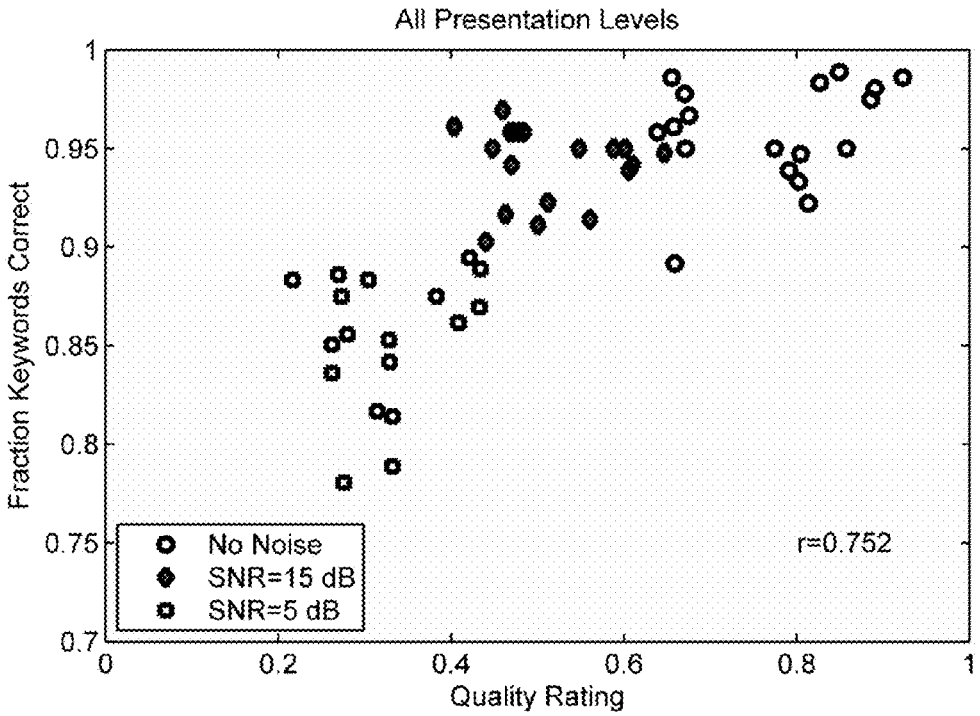
FIG. 10 shows relationship between intelligibility scores and normalized quality ratings averaged over listener and talker.

FIG. 10 presents the relationship between intelligibility and quality. Each point represents one combination of SNR, level, and type of processing after being averaged over listener and talker. The open circles are data for no noise, the solid diamonds are for SNR=15 dB, and the open squares are for SNR=5 dB. The results for the different noise levels form distinct clusters, and the correlation between intelligibility and quality appears to be more closely related to the effect of the noise level that separates the clusters than on the factors of level or processing that represent the points within each cluster. The Pearson correlation coefficient is r=0.752 (r2=0.566), so knowledge of intelligibility or quality accounts for a little over half of the variance of the other value.

The results show similar trends in the data for intelligibility and quality, with the QL algorithm giving both the highest intelligibility and quality. The quality ratings show larger differences than observed for the intelligibility scores. This result is consistent with quality being a more sensitive discriminator of processing differences. When intelligibility is poor the quality rating is dominated by the loss of intelligibility, but at high intelligibility the quality ratings can still discriminate between processing conditions. Intelligibility was near saturation for many of the processing conditions used in the experiment, leaving quality as the major difference. Quality, however, is an important factor in hearing-aid success, so an improvement in quality is a useful advance in hearing-aid design.

The results illuminate the trade-off between audibility and distortion. An implicit assumption in conventional WDRC is that the hearing-impaired listener will not be affected by the distortion introduced by the compression. However, it has been shown that for speech quality and for music quality, hearing-impaired listeners are just as sensitive to distortion as are normal-hearing listeners. For speech at 65 dB SPL, the NAL-R linear filter gave high intelligibility and high quality. The superiority of NAL-R is consistent with the hypothesis that compression is undesirable if linear amplification can provide sufficient audibility. When the signal level is reduced to 55 dB SPL, the intelligibility and quality for NAL-R are greatly reduced and NAL-NL1 gives better performance. So when the reduction in intensity is great enough, the distortion introduced by compression is preferable to the loss in signal audibility.

The new method resolves the conflict between audibility and distortion. For speech at 65 dB SPL, the QL and MinCR approaches give intelligibility and quality similar to NAL-R. For speech at 55 dB SPL, the QL and MinCR approaches give intelligibility and quality as good as or better than NAL-NL1. The new algorithms ensure audibility while minimizing distortion, and thus give results comparable to choosing the better of linear amplification or WDRC in response to the signal intensity, dynamic range, and SNR.

The superiority of the new method counters the conventional wisdom that loudness scaling is the best way to design a WDRC system. The new method is based on keeping the processing as linear as possible while ensuring audibility. These results suggest that matching the loudness of the speech in the impaired ear to that in a normal ear is not as important as preserving the integrity of the short-term signal dynamics. The ability to detect dynamic changes in the signal (e.g. intensity just noticeable differences or JNDs) is similar in hearing-impaired and normal-hearing listeners despite the hearing-impaired listeners having more extreme slopes in their growth of loudness curves. The ability to extract speech envelope modulation is also similar in the two groups. Furthermore, preserving the speech envelope dynamics is important for maintaining speech intelligibility and speech quality for both normal-hearing and hearing-impaired listeners. Since speech intelligibility and quality are related to preserving the signal dynamics, the similarity in intensity JNDs and envelope modulation detection between normal-hearing and hearing-impaired listeners may be more important than the difference in growth of loudness.

Embodiments and aspects are disclosed in the following Items:

1. A hearing aid comprising a microphone for conversion of acoustic sound into an input audio signal, a signal processor for processing the input audio signal for generation of an output audio signal, the signal processor including a compressor with a compressor input/output rule, a transducer for conversion of the output audio signal into a signal to be received by a human, characterized in that the compressor input/output rule is variable in response to a signal level of the audio input signal.

2. A hearing aid according to item 1, wherein the compressor input/output rule is variable in response to an estimated signal dynamic range of the audio input signal.

3. A hearing aid according to item 1 or 2, wherein a compression ratio of the input/output rule is variable.

4. A hearing aid according to any of the previous items, further comprising a valley detector for determination of a minimum value of the input audio signal, wherein a first gain value of the compressor for a selected first signal level is increased if the determined minimum value times a compressor gain at the determined minimum level is less than a hearing threshold.

5. A hearing aid according to item 4, wherein the first gain value of the compressor for the selected first signal level is decreased if the determined minimum value times the compressor gain at the determined minimum value is greater than the hearing threshold.

6. A hearing aid according to item 4 or 5, further comprising a peak detector for determination of a maximum value of the input audio signal, wherein a second gain value of the compressor for a selected second signal level is increased if the determined maximum value times a compressor gain at the determined maximum value is less than a pre-determined allowable maximum level, such as the loudness discomfort level.

7. A hearing aid according to item 6, wherein the second gain value of the compressor for the selected second signal level is decreased if the determined maximum value times the compressor gain at the determined maximum value is greater than the pre-determined allowable maximum level, such as the loudness discomfort level.

8. A hearing aid according to any of items 5-7, wherein the first gain value is maintained below a specific first maximum value.

9. A hearing aid according to any of items 6-8, wherein the second gain value is maintained below a specific second maximum value.

10. A hearing aid according to any of the preceding items, wherein the processor is further configured to process the signal in a plurality of frequency channels, and wherein the compressor is a multi-channel compressor, and wherein the compressor input/output rule is variable in response to the signal level in at least one frequency channel of the plurality of frequency channels.

11. A hearing aid according to item 10, wherein the plurality of frequency channels comprises warped frequency channels.

12. A method of hearing loss compensation with a hearing aid comprising a microphone for conversion of acoustic sound into an input audio signal, a signal processor for processing the input audio signal for generation of an output audio signal, the signal processor including a compressor, and a transducer for conversion of the output audio signal into a signal to be received by a human, the method comprising the steps of:

fitting the compressor input/output rule in accordance with the hearing loss of the intended user, and varying the compressor input/output rule in response to a signal level of the audio input signal.

The invention claimed is:

1. A hearing aid, comprising:

a microphone for conversion of acoustic sound into an input audio signal;

a signal processor for processing the input audio signal for generation of an output audio signal;

a transducer for conversion of the output audio signal into a signal to be received by a human; and a valley detector for determination of a minimum value of the input audio signal;

wherein the signal processor includes a compressor with a compressor input/output rule that is variable in response to a signal level of the input audio signal, and wherein a gain value of the compressor is variable based at least in part on an evaluation of a parameter derived using the determined minimum value against a threshold.

2. The hearing aid according to claim 1, wherein the compressor input/output rule is variable in response to an estimated signal dynamic range of the input audio signal.

3. The hearing aid according to claim 1, wherein a compression ratio of the input/output rule is variable.

4. A hearing aid comprising:

a microphone for conversion of acoustic sound into an input audio signal;

a signal processor for processing the input audio signal for generation of an output audio signal; and a transducer for conversion of the output audio signal into a signal to be received by a human;

wherein the signal processor includes a compressor with a compressor input/output rule that is variable in response to a signal level of the input audio signal; and wherein the hearing aid further comprises a valley detector for determination of a minimum value of the input audio signal, wherein a first gain value of the compressor for a first signal level is increased if the determined minimum value times a compressor gain at the determined minimum value is less than a threshold.

5. The hearing aid according to claim 4, wherein the first gain value of the compressor for the first signal level is decreased if the determined minimum value times the compressor gain at the determined minimum value is greater than the threshold.

6. The hearing aid according to claim 4, further comprising a peak detector for determination of a maximum value of the input audio signal, wherein a second gain value of the compressor for a second signal level is increased if the determined maximum value times a compressor gain at the determined maximum value is less than a pre-determined allowable maximum level.

7. The hearing aid according to claim 6, wherein the second gain value of the compressor for the second signal level is decreased if the determined maximum value times the compressor gain at the determined maximum value is greater than the pre-determined allowable maximum level.

8. The hearing aid according to claim 5, wherein the first gain value is maintained below a maximum gain value.

9. The hearing aid according to claim 6, wherein the second gain value is maintained below a maximum gain value.

10. A method of hearing loss compensation with a hearing aid comprising a microphone for conversion of acoustic sound into an input audio signal, a signal processor for processing the input audio signal for generation of an output audio signal, the signal processor including a compressor, a transducer for conversion of the output audio signal into a signal to be received by a human, and a valley detector for determination of a minimum value of the input audio signal, the method comprising:

fitting the compressor input/output rule in accordance with a hearing loss of a user; and varying the compressor input/output rule in response to a signal level of the input audio signal;

wherein a gain value of the compressor is increased if the determined minimum value times a compressor gain is less than a threshold.

11. A hearing aid, comprising:

a microphone for conversion of acoustic sound into an input audio signal;

a signal processor for processing the input audio signal for generation of an output audio signal;

a transducer for conversion of the output audio signal into a signal to be received by a human; and a detector for determination of a minimum value of the input audio signal;

wherein the signal processor includes a compressor, and wherein a gain value of the compressor increases or decreases based on whether a parameter exceeds a threshold or not, the parameter being based on the minimum value of the input audio signal.

12. The hearing aid of claim 11, wherein the gain value of the compressor increases if the parameter is less than the threshold.

13. The hearing aid of claim 11, wherein the gain value of the compressor decreases if the parameter is greater than the threshold.

14. The hearing aid of claim 11, wherein the parameter comprises a result of a multiplication operation involving the minimum value.

15. The hearing aid of claim 14, wherein the multiplication operation also involves a compressor gain.

* * * * *